313-414 SR
12/10/85 OR 4,558,253

United States Patent [19]
Bechis et al.

[11] Patent Number: 4,558,253
[45] Date of Patent: Dec. 10, 1985

[54] COLOR PICTURE TUBE HAVING AN INLINE ELECTRON GUN WITH ASYMMETRIC FOCUSING LENS

[75] Inventors: Dennis J. Bechis, Lawrenceville, N.J.; Hsing-Yao Chen, Landisville; Richard H. Hughes, Lancaster, both of Pa.

[73] Assignee: RCA Corporation, Princeton, N.J.

[21] Appl. No.: 485,860

[22] Filed: Apr. 18, 1983

[51] Int. Cl.[4] ..... H01J 29/62
[52] U.S. Cl. ..... 313/414
[58] Field of Search ..... 313/414, 412, 413

[56] References Cited

U.S. PATENT DOCUMENTS

| | | | |
|---|---|---|---|
| 2,975,315 | 3/1961 | Szegho . | |
| 3,497,763 | 2/1970 | Hasker | 315/31 |
| 3,852,637 | 12/1974 | Yamazaki et al. | 315/16 |
| 3,866,081 | 2/1975 | Hasker et al. | 313/449 |
| 3,873,879 | 3/1975 | Hughes | 315/13 C |
| 4,234,814 | 11/1980 | Chen et al. | 313/412 |
| 4,242,613 | 12/1980 | Brambring et al. | 313/447 |
| 4,251,747 | 2/1981 | Burdick | 313/348 |
| 4,272,700 | 6/1981 | Collins | 313/458 |
| 4,334,169 | 6/1982 | Takenaka et al. | 313/414 |
| 4,370,592 | 1/1983 | Hughes et al. | 313/414 |
| 4,374,341 | 2/1983 | Say | 313/414 |
| 4,473,775 | 9/1984 | Hosokoshi et al. | 313/414 X |

FOREIGN PATENT DOCUMENTS

| | | | |
|---|---|---|---|
| 84554 | 5/1982 | Japan | 313/414 |
| 59534 | 4/1983 | Japan | 313/414 |
| 2101397 | 1/1983 | United Kingdom | 313/412 |

*Primary Examiner*—Palmer C. DeMeo
*Attorney, Agent, or Firm*—Eugene M. Whitacre; Dennis H. Irlbeck

[57] ABSTRACT

A color picture tube includes a screen and an improved inline gun for generating and directing three inline electron beams along separate paths toward the screen. The improved electron gun has an asymmetric beam-forming region and an asymmetric main focus lens. The asymmetry of the main focus lens is matched with the asymmetry of the beam-forming region to focus substantially all portions of each of the beams at the screen.

9 Claims, 6 Drawing Figures

COLOR PICTURE TUBE HAVING AN INLINE ELECTRON GUN WITH ASYMMETRIC FOCUSING LENS

The present invention relates to color picture tubes having inline electron guns, and particularly to an improvement in such guns to provide a high degree of insensitivity to deflection defocusing and flare of the electron beams.

BACKGROUND OF THE INVENTION

An inline electron gun is one designed to generate or initiate preferably three electron beams in a common plane and direct those beams along convergent paths in that plane to a point or small area of convergence near the tube screen. In one type of inline electron gun, such as that shown in U.S. Pat. No. 3,873,879, issued to R. H. Hughes on Mar. 25, 1975, the main electrostatic focusing lenses for focusing the electron beams are formed between two electrodes referred to as the first and second accelerating and focusing electrodes.

The concept of utilizing two electrostatic focusing lenses to form an effective larger main focus lens is disclosed in U.S. Pat. No. 2,975,315 issued to C. S. Szegho on Mar. 14, 1961, in U.S. Pat. No. 3,852,637 issued to E. Yamazaki et al. on Dec. 3, 1974, and in U.S. Pat. No. 4,334,169 issued to S. Takenaka et al. on June 8, 1982. In each of these patents, four electrodes are used to form the two electrostatic focusing lenses. In each patent, one lens is formed by three of the electrodes with the center electrode being excited with a lower voltage than the two-side electrodes which are electrically connected. The other lens in these patents is formed by two electrodes excited with different voltages.

An inline electron gun wherein a bipotential electrostatic focusing lens is expanded in size is disclosed in U.S. Pat. No. 4,370,592 issued to R. H. Hughes et al. on Jan. 25, 1983. In this patent, the enlarged lens is formed by setting back or recessing the three inline apertures in each of two focus electrodes so that the rims around the recesses which face each other provide the primary control in forming the main focus lens.

The concept of forming an astigmatic lens in the beam forming region of an electron gun by the inclusion of a slot in the first electrode grid is disclosed in the following patents: U.S. Pat. No. 4,242,613 issued to J. Brambring et al. on Dec. 30, 1980; U.S. Pat. No. 4,251,747 issued to G. A. Burdick on Feb. 17, 1981; and U.S. Pat. No. 4,272,700 issued to F. K. Collins on June 9, 1981. Slots in the second electrode grid are disclosed in the following patents: U.S. Pat. No. 3,497,763 issued to J. Hasker on Feb. 24, 1970; U.S. Pat. No. 3,866,081 issued to J. Hasker et al. on Feb. 11, 1975; and U.S. Pat. No. 4,234,814 issued to H. Y. Chen at al. on Nov. 18, 1980.

The foregoing patents provide varying contributions to the cathode-ray tube art, which in themselves are valuable, but the patents do not suggest how the varying concepts disclosed therein can be combined to obtain an electron gun having decidedly improved performance.

SUMMARY OF THE INVENTION

A color picture tube includes a screen and an improved inline gun for generating and directing three inline electron beams along separate paths toward the screen. The improved electron gun has an asymmetric beam-forming region and an asymmetric main focus lens. The asymmetry of the main focus lens is matched with the asymmetry of the beam-forming region to focus substantially all portions of each of the beams at the screen.

DETAILED DESCRIPTION OF THE PREFERRED EMBODIMENT

Figure 1:
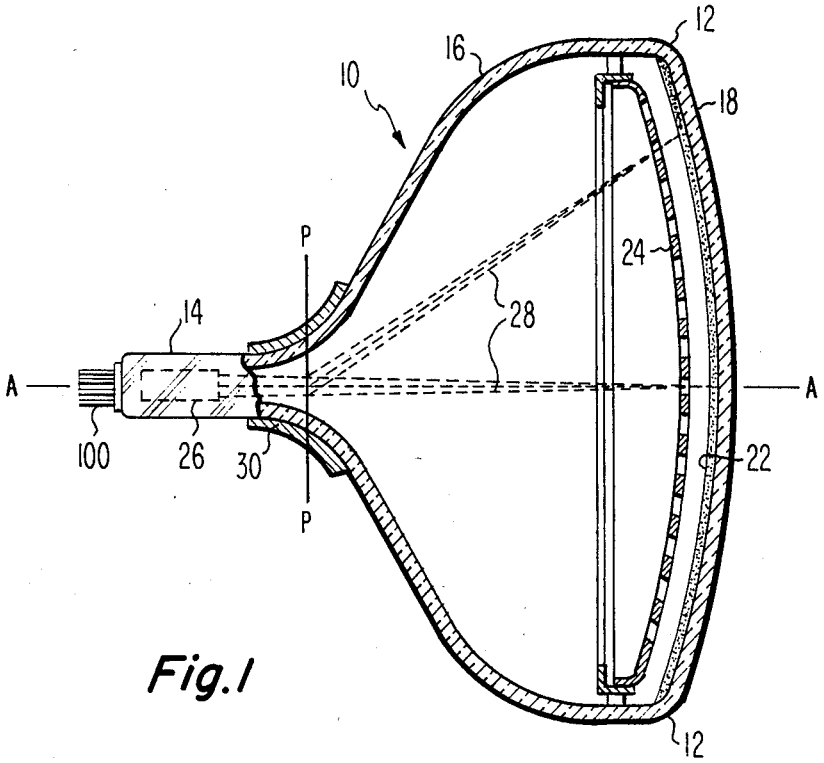
FIG. 1 is a plan view, partly in axial section, of a shadow mask color picture tube embodying the invention.

FIG. 1 is a plan view of a rectangular color picture tube 10 having a glass envelope comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A three-color phosphor screen 22 is carried by the inner surface of the faceplate 18. The screen is preferably a line screen with the phosphor lines extending substantially perpendicular to the high frequency raster line scan of the tube (normal to the plane of FIG. 1). A multi-apertured color-selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the self-converging yoke 30 shown surrounding the neck 14 and funnel 12 in the neighborhood of their junction. When activated, the yoke 30 subjects the three beams 28 to vertical and horizontal magnetic flux which cause the beams to scan horizontally and vertically, respectively, in a rectangular raster over the screen 22. The initial plane of deflection (at zero deflection) is shown by the line P—P in FIG. 1 at about the middle of the yoke 30. Because of fringe fields, the zone of deflection of the tube extends axially, from the yoke 30 into the region of the electron gun 26. For simplicity, the actual curvature of the deflected beam paths in the deflection zone is not shown in FIG. 1.

Figure 4:
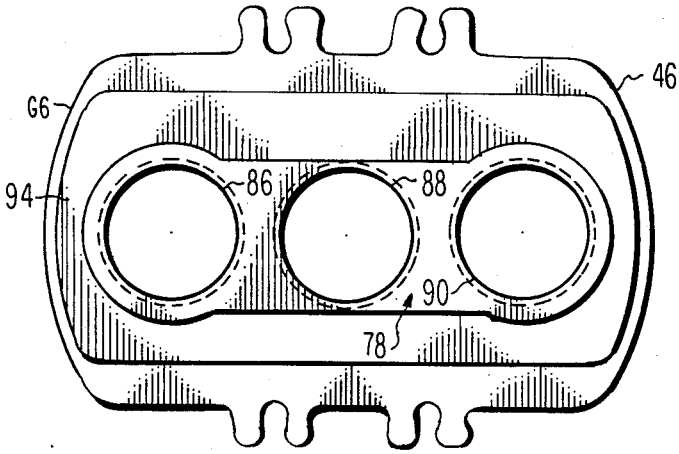
FIG. 4 is a plan view of the G6 electrode taken at line 4—4 of FIG. 3.
Figure 5:
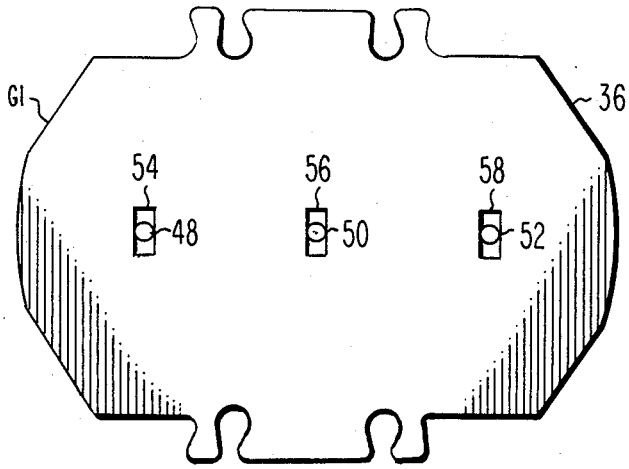
FIG. 5 is a plan view of a side of the G1 electrode of the electron gun of FIG. 2 that faces the G2 electrode.

The details of the electron gun 26 are shown in FIGS. 2 through 5. The electron gun comprises two glass supports rods 32 on which various electrodes are mounted. These electrodes include three equally spaced coplanar cathodes 34 (one for each beam), a G1 grid electrode 36, a G2 grid electrode 38, a G3 electrode 40, a G4 electrode 42, a G5 electrode 44, and a G6 electrode 46 spaced along the glass rods 32 in the order named. All of the electrodes have three inline apertures in them to permit passage of three coplanar electron beams. The G1 grid electrode 36 and the G2 grid electrode 38 are parallel flat plates that can include embossings therein for added strength. In addition to three inline apertures 48, 50 and 52, the G1 grid electrode 36 also includes three slots 54, 56 and 58, respectively, superposed on the apertures, on the side of the G1 grid electrode 36 facing the G2 grid electrode 38, as shown in FIG. 5. The elongated dimension of the slots 54, 56 and 58 extends in a direction perpendicular to the inline direction of the apertures. The G3 electrode 40 is formed with a cup-shaped element 60, the bottom of which faces the G2 grid electrode 38, and a plate-shaped element 62 covering the open end of the cup-shaped element 60. The G4 electrode 42 is formed from two shallow cup-shaped members 64 and 66 that are connected at their open ends. The G5 electrode 44 is formed with three cup-shaped elements 68, 70 and 72. The closed end of one of the elements 70 is nested in the open end of another element 68 with the closed end of the element 68 facing the G4 electrode 42. The open ends of the elements 70 and 72 are connected. Although the G5 electrode 44 is shown as a three-piece structure, it could be fabricated from any number of elements. The G6 electrode 46 also is cup-shaped and has its open end closed with the apertured closed end of a shield cup 74.

Figure 2:
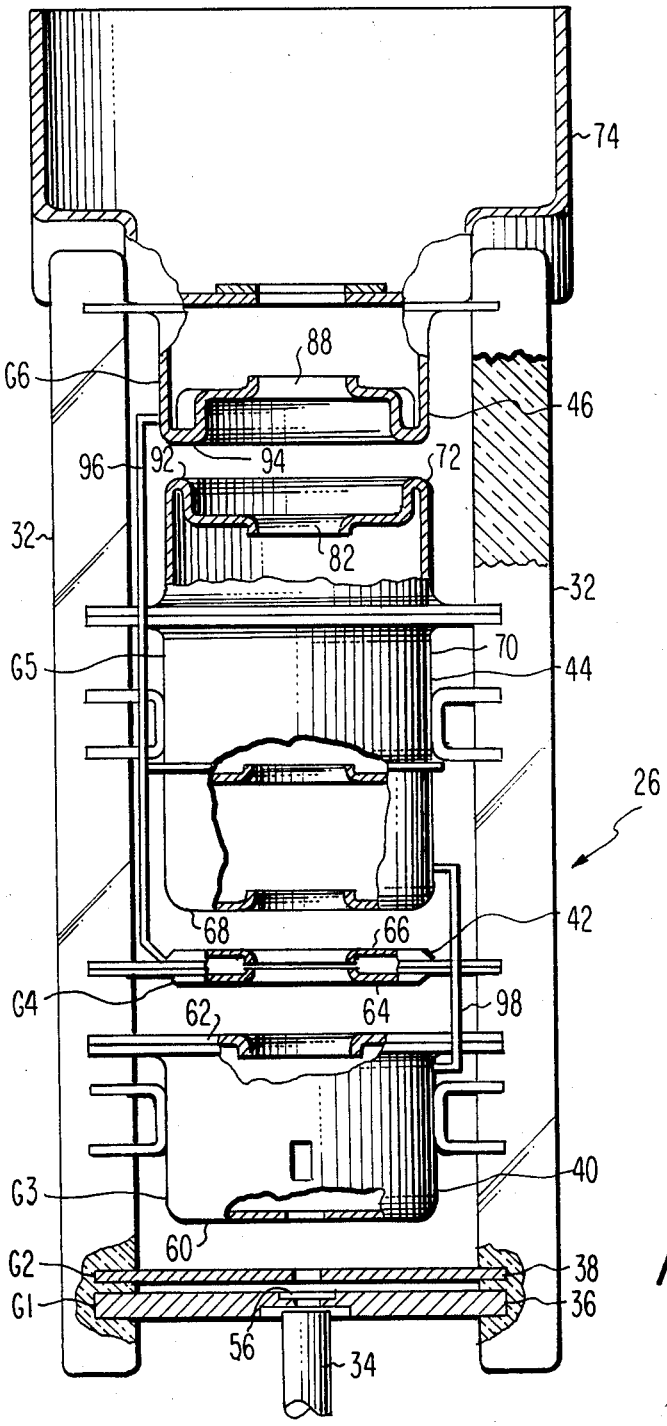
FIG. 2 is a partial axial section view of the electron gun shown in dashed lines in FIG. 1.
Figure 3:
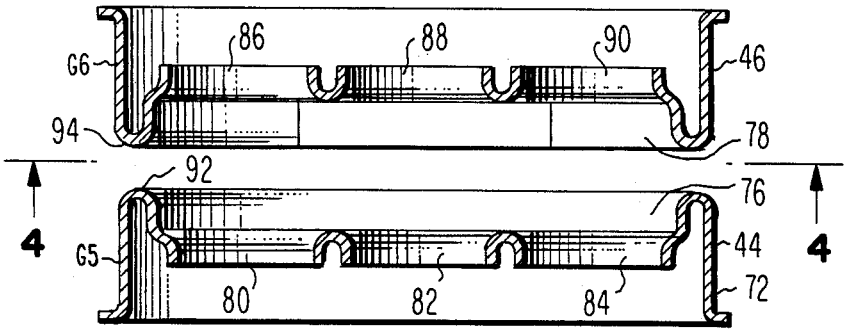
FIG. 3 is an axial sectional view of the G5 and G6 electrodes of the electron gun of FIG. 2.

The facing closed ends of the G5 electrode 44 and the G6 electrode 46, as shown in FIG. 2, have large recesses 76 and 78, respectively, therein. The recesses 76 and 78 set back the portion of the closed end of the G5 electrode 44 that contains three apertures 80, 82 and 84 from the portion of the closed end of the G6 electrode 46 that contains three apertures 86, 88, and 90. The remaining portions of the closed ends of the G5 electrode 44 and the G6 electrode 46 form rims 92 and 94, respectively, that extend peripherally around the recesses 76 and 78. The rims 92 and 94 are the closest portions of the two electrodes 44 and 46 to each other. The configuration of the recess 78 in the G6 electrode 46 is slightly different than that of the recess 76 in the G5 electrode 44. As shown in FIG. 4, the recess 78 is narrower at the center aperture 88 than at the side apertures 86 and 90, whereas the recess 76 in G5 electrode is uniform in width at the three apertures 80, 82 and 84 therein.

The G4 electrode 42 is electrically connected by a lead 96 to the G6 electrode 46 and the G3 electrode 40 is electrically connected by a lead 98 to the G5 electrode 44, as shown in FIG. 2. Separate leads (not shown) connect the G3 electrode 40, the G2 grid electrode 38, the G1 grid electrode 36, the cathodes 34 and the cathode heaters to a base 100 (shown in FIG. 1) of the tube 10 so that these components can be electrically excited. Electrical excitation of the G6 electrode 46 is obtained by a contact between the shield cup 76 and an internal conductive coating in the tube which is connected to an anode button extending through the funnel 16.

In the electron gun 26, the cathodes 34, the G1 grid electrode 36 and the G2 grid electrode 38 comprise the beam-forming region of the gun. During tube operation, modulated control voltages are applied to the cathodes 34, the G1 grid electrode 36 is grounded and a relatively low positive voltage (e.g. 800 to 1100 volts) is applied to the G2 grid electrode 38. The G3 electrode 40, the G4 electrode 42, and the facing portion of the G5 electrode 44 comprises a prefocusing lens portion of the electron gun 26. During tube operation, a focus voltage is applied to both the G3 electrode 40 and to the G5 electrode 44 and the ultor or anode voltage is applied to the G4 electrode 42. The facing portions of the G5 electrode 44 and the G6 electrode 46 comprise the main focus lens of the electron gun 26. During tube operation, the anode voltage is applied to the G6 electrode 46 so that a bipotential focus lens is formed between the G5 and G6 electrodes.

Some typical dimensions for the electron gun 26 of FIG. 2 are presented in the following table.

TABLE

| | |
|---|---|
| External diameter of tube neck | 29.00 mm. |
| Internal diameter of tube neck | 24.00 mm. |
| Spacing between G1 and G2 electrodes | 0.18 mm. |
| Spacing between G2 and G3 electrodes | 1.19 mm. |
| Spacing between G3 and G4 electrodes | 1.27 mm. |
| Spacing between G4 and G5 electrodes | 1.27 mm. |
| Spacing between G5 and G6 electrodes | 1.27 mm. |
| Center-to-Center spacing between adjacent apertures in G5 electrode | 5.08 mm. |
| Diameter of Apertures in G5 and G6 electrodes | 4.06 mm. |
| Depth of recess in G5 electrode | 2.03 mm. |
| Thickness of G1 electrode | 0.10 mm. |
| Thickness of G2 electrode | 0.25 to 0.50 mm. |
| Length of G3 electrode | 5.64 to 10.67 mm. |
| Length of G4 electrode | 0.51 to 1.78 mm. |
| Length of G5 electrode | 17.22 mm. |
| Length of slots in G1 electrode | 1.98 mm. |
| Width of slots in G1 electrode | 0.71 mm. |
| Depth of slots in G1 electrode | 0.10 to 0.30 mm. |
| Focus voltage | 7.8 to 9.5 kV |
| Anode voltage | 25 kV |

GENERAL CONSIDERATIONS

The foregoing preferred embodiment combines several electron gun design concepts that were known in the prior art. These concepts represent only a few of the many possible alternate design concepts that could be used in each part of an electron gun. Although the design concepts utilized herein were known individually, there was no teaching or appreciation in the prior art of how these concepts could be selected from the many alternatives and combined to achieve an electron gun having greatly improved electron-optical performance.

To achive self-convergence of the three electron beams in an in-line system, the horizontal deflection field must be pincushion-shaped. Unfortunately, such a field greatly overfocusses each beam in the vertical plane during horizontal deflection. This vertical deflection defocusing leads to objectionable amounts of flare on the top and bottom of electron beam spots at the edges and corners of the phosphor screen. The simultaneous improvement of spot size and deflection defocussing is difficult to achieve with round beams. For example, the smaller the diameter of a round beam is in the yoke fields, the less deflection defocusing it suffers, but the larger the spot size is at the screen. However, elliptical beams of small vertical and large horizontal size in the yoke fields offer a solution to this problem. The small vertical size makes the beam spot less sensitive to vertical overfocussing of the yoke while the large horizontal size reduces space charge effects in the drift region and leads to a smaller spot at the screen.

Figure 6:
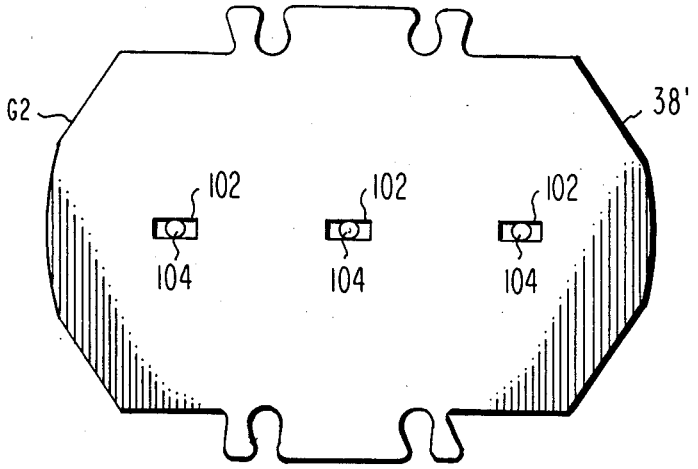
FIG. 6 is a plan view of a side of a G2 electrode of another electron gun embodiment that faces a G1 electrode.

To obtain elliptical beams, the present invention incorporates an asymmetrical beam-forming region into the electron gun. Preferably, such an asymmetrical beam-forming region is formed by the utilization of vertical slots in the G1 grid, as described with respect to the preferred embodiment. However, horizontal slots 102 in the G2 grid electrode 38′ may also be used, as shown in FIG. 6. Such horizontal slots 102 are superposed on the apertures 104 on the G1 grid side of the G2 grid. Since the G1 slots yield somewhat more elliptical electron beams than do the G2 slots, the slotted G1 concept is preferred. However, a combination of both G1 slots and G2 slots also may be used in the beam-forming region.

If elliptical beams were focused by symmetrical optics in the main focus lens of an electron gun, the beam rays along the horizontal axis of each beam would be in focus but the beam rays at the ends of the vertical axis would be underfocused. The underfocusing would result in an astigmatic electron beam spot on the screen which had a undesirable relatively large vertical dimension. The present invention overcomes this astigmatic focusing problem by providing an asymmetric main focus lens which is matched to the asymmetry of the beam-forming region so that substantially all beam rays are focused at the tube screen. In the preferred embodiment, the main focus lens is formed by the G5 and G6 electrodes. In this embodiment, the somewhat oval or nonsymmetrical shape of the electrode rims form the asymmetric lens field. Furthermore, since the electrode rims form an expanded main focus lens, in that the lens is larger than that which would be formed by the separate apertures, the electron beams have less aberrations than would be caused by a smaller main focus lens.

In order to achieve a small vertical size of the elliptical beams in the deflection fields of the yoke, it is necessary to maintain a small vertical size of the beam in the main focus lens. It is difficult to maintain a small vertical size of a beam in a bipotential electron gun operated at a high focus voltage because of the need for a long accelerating electrode which permits some spreading of the beam before it enters the main focus lens. The preferred embodiment compensates for this problem by the addition of a prefocus lens between the beam-forming region and the main focus lens. Such prefocus lens reduces beam spreading and ensures that the beam will have a small vertical size in the main focus lens.

Although the preferred embodiment has been described with respect to an electron gun having a prefocus lens, the aspect of the present invention of matching an asymmetric beam-forming region with an asymmetric focus lens can be applied to other types of electron guns. For example, an appropriate matching asymmetric beam-forming region can be included in the bipotential electron gun disclosed in U.S. Pat. No. 4,370,592 issued to R. H. Hughes et al. on Jan. 25, 1983, which patent is hereby incorporated by reference for its disclosure of an electron gun having an asymmetric main focus lens. Both the electron gun of the Hughes et al. patent, as modified by the inclusion of a matching asymmetric beam-forming region, amd the electron gun of the preferred embodiment exhibit a high degree of insensitivity to deflection defocusing and flare of the electron beams.

What is claimed is:

1. In a color picture tube including a screen and an inline electron gun for generating and directing three inline electron beams along separate paths toward said screen, the improvement comprising said electron gun having an asymmetric beam-forming region including three inline cathodes and at least two electrodes, a first electrode and a second electrode respectively spaced from said cathodes, each electrode including three inline apertures therein which are substantially aligned with said cathodes, and wherein said first electrode includes a separate slot superposed on each of the apertures therein, each of said slots facing said second electrode and being elongated in a direction perpendicular to the inline direction of the apertures in said first electrode, said electron gun having an asymmetric main focus lens, the asymmetry of said main focus lens being matched with the asymmetry of said beam-forming region to focus substantially all portions of each of said beams at said screen, said main focus lens including two focus electrodes, the facing portions of which each including a peripheral rim and three separate inline apertures therein set back from the rim, and said peripheral rims being elongated in the inline direction of said inline apertures and forming an asymmetric focus field, and said electron gun including a prefocus lens between said beam-forming region and said main focus lens, said prefocus lens comprising three electrodes including two electrically connected side electrodes, one of which is common with one of said main focus lens electrodes, and a center electrode which is electrically connected to the other of said main focus lens electrodes that is not common to a prefocus lens electrode.

2. An inline electron gun for generating and directing three inline electron beams along separate paths, comprising six electrodes spaced from three inline cathodes, each electrode including at least three inline apertures for the passage of three electron beams therethrough, the third and fifth electrodes from said cathodes being electrically connected and the fourth and sixth electrodes from said cathodes being electrically connected and operable at an anode voltage, the facing portions of the fifth and sixth electrodes from said cathodes each include a peripheral rim and three separate inline apertures therein set back from the rim, said peripheral rims being elongated in the inline direction of said inline apertures and forming an asymmetric focus field, the first and second electrodes from said cathodes comprising a beam-forming region of said gun, and the beam-forming region including means for forming an asymmetric electrostatic lens along each of said electron beam paths, the asymmetry of said lenses being matched to the asymmetry of said focus field formed by the peripheral rims of the fifth and sixth electrodes.

3. The electron gun as defined in claim 2 wherein the asymmetric electrostatic lens of said beam-forming region is formed by said first electrode including a separate slot superposed on each of the apertures therein, each of said slots facing said second electrode and being elongated in a direction perpendicular to the inline direction of the apertures in said first electrode.

4. The electron gun as defined in claim 2 wherein the asymmetric electrostatic lens of said beam-forming region is formed by said second electrode including a separate slot superposed on each of the apertures therein, each of said slots facing said first electrode and being elongated in a direction parallel with the inline direction of the apertures in said second electrode.

5. An electron gun for generating at least one electron beam, comprising an asymmetric beam-forming region including a cathode and at least two electrodes each having at least one aperture therein, at least one of the beam-forming region electrodes including a slot superposed on an aperture therein for forming an asymmetric field, a two electrode asymmetric main focusing lens, the asymmetry of said main focusing lens being matched to the asymmetry of said beam-forming region to focus substantially all portions of the electron beam at a common position relative to said electron gun, and a three electrode prefocus lens located between said beam-forming region and said main focus lens wherein an electrode of said main focusing lens and said prefocus lens are common.

6. In a color picture tube including a screen and an inline electron gun for generating and directing three inline electron beams along separate paths toward said screen, the improvement comprising said electron gun having an asymmetric beam-forming region and an asymmetric main focus lens, the asymmetry of said main focus lens being matched with the asymmetry of said beam-forming region to focus substantially all portions of each of said beams at said screen, said main focus lens being formed by two electrodes, said electron gun including a three electrode prefocus lens between said beam-forming region and said main focus lens, and said beam-forming region including three inline cathodes and at least two electrodes, a first electrode and a second electrode respectively spaced from said cathodes, each electrode including three inline apertures therein which are substantially aligned with said cathodes, and wherein said first electrode includes a separate slot superposed on each of the apertures therein, each of said slots facing said second electrode and being elongated in a direction perpendicular to the inline direction of the apertures in said first electrode.

7. The tube as defined in claim 6 wherein the facing portions of the two main focus lens electrodes each include a peripheral rim and three separate inline apertures therein set back from the rim, and said peripheral rims are elongated in the inline direction of said inline apertures and form an asymmetric focus field.

8. The tube as defined in claim 6 wherein the three electrode prefocus lens comprises two electrically connected side electrodes and a center electrode having different electrical connection means.

9. In a color picture tube including a screen and an inline electron gun for generating and directing three inline electron beams along separate paths toward said screen, the improvement comprising said electron gun having an asymmetric beam-forming region and an asymmetric main focus lens, the asymmetry of said main focus lens being matched with the asymmetry of said beam-forming region to focus substantially all portions of each of said beams at said screen, said main focus lens being formed by two electrodes, said electron gun including a three electrode prefocus lens between said beam-forming region and said main focus lens, and said beam-forming region including three inline cathodes and at least two electrodes, a first electrode and a second electrode respectively spaced from said cathodes, each electrode including three inline apertures therein which are substantially aligned with said cathodes, and wherein said second electrode includes a separate slot superposed on each of the apertures therein, each of said slots facing said first electrode and being elongated in a direction parallel to the inline direction of the apertures in said second electrode.

* * * * *